US006835885B1

(12) United States Patent
Kondo et al.

(10) Patent No.: US 6,835,885 B1
(45) Date of Patent: Dec. 28, 2004

(54) TIME-AXIS COMPRESSION/EXPANSION METHOD AND APPARATUS FOR MULTITRACK SIGNALS

(75) Inventors: Kazunobu Kondo, Hamamatsu (JP); Koji Niimi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 663 days.

(21) Appl. No.: 09/634,215

(22) Filed: Aug. 9, 2000

(30) Foreign Application Priority Data

Aug. 10, 1999 (JP) ..... 11-226264

(51) Int. Cl.[7] ..... G10H 7/00
(52) U.S. Cl. ..... 84/612
(58) Field of Search ..... 84/611, 612, 634, 84/635

(56) References Cited

U.S. PATENT DOCUMENTS

| | | | | |
|---|---|---|---|---|
| 5,749,064 A | | 5/1998 | Pawate et al. | 704/213 |
| 5,842,172 A | | 11/1998 | Wilson | 704/503 |
| 5,845,247 A | | 12/1998 | Miyasaka | 704/267 |
| 6,049,766 A | | 4/2000 | Laroche | 704/216 |
| 6,169,240 B1 | * | 1/2001 | Suzuki | 84/605 |
| 6,169,241 B1 | * | 1/2001 | Shimizu | 84/605 |
| 6,207,885 B1 | * | 3/2001 | Nogami et al. | 84/636 |
| 6,232,540 B1 | | 5/2001 | Kondo | 84/612 |
| 6,484,137 B1 | | 11/2002 | Taniguchi et al. | 704/211 |
| 6,487,536 B1 | * | 11/2002 | Koezuka et al. | 704/500 |

FOREIGN PATENT DOCUMENTS

| | | | |
|---|---|---|---|
| JP | 1093795 | 4/1989 | |
| JP | 5273964 | 10/1993 | |
| JP | 6175663 | 6/1994 | |
| JP | 9034448 | 2/1997 | |
| JP | 9062257 | 3/1997 | |
| JP | 10282963 | 10/1998 | G10H/7/00 |

* cited by examiner

*Primary Examiner*—Jeffrey W. Donels
(74) *Attorney, Agent, or Firm*—Pillsbury Winthrop LLP

(57) ABSTRACT

A time-axis compression/expansion method and apparatus for multitrack signals is provided, which is capable of performing time-axis compression/expansion on a multi-track signal in such an appropriate manner as to prevent a degradation in the sound quality of a sound generated through a multichannel reproduction or a sound generated through reproduction of a musical tone signal obtained by mix-down. Positions of attacks of the rhythm track sound source signal of a plurality of track sound source signals are detected. Portions of the rhythm track sound source signal between the detected positions of attacks are subjected to a first time-axis compression/expansion process, and the other track sound source signals are subjected to a second time-axis compression/expansion process, based on the detected positions of attacks.

9 Claims, 16 Drawing Sheets

Time
To
Lmax
Lmax
Lmin
Lmin

Time
Lp
Lp
L

WaveA
WaveB
Time
To+L

WaveA
Time

WaveB
Time

L-2*Lp
Time
WaveA+WaveB
NewTo

Time
To
Lmax
Lmax
Lmin
Lmin

Time
Lp
Lp
L
WaveA
WaveB

Time
To
To+L

Time

Time
L-2*Lp

Time
WaveA
WaveA+WaveB
WaveB
NewTo

TIME-AXIS COMPRESSION/EXPANSION METHOD AND APPARATUS FOR MULTITRACK SIGNALS

BACKGROUND OF THE INVENTION

1. Field of the Invention

This invention relates to a time-axis compression/expansion method and apparatus for performing time-axis compression/expansion on original digital signals at a desired compression/expansion rate without changing the pitch of the original digital signals, and more particularly to a time-axis compression/expansion method and apparatus of this kind which is suitable for performing time-axis compression/expansion on a multitrack signal.

2. Prior Art

The time-axis compression/expansion technique for time-axis compressing or time-axis expanding a digital audio signal without changing the pitch of the same is utilized e.g. for so-called "time length adjustment" for adjusting a total recording time period over which the digital audio signal is to be recorded to a predetermined time period, tempo conversion in a karaoke apparatus or the like, and so forth. Conventionally, this kind of time-axis compression/expansion technique includes a cut-and-splice method (as disclosed e.g. in Japanese Laid-Open Patent Publication (Kokai) No. 10-282963), an overlap-add method based on pointer shift amount control (Morita & Itakura, "Expansion/Compression of Sound in Time Product by Using Overlap-Add Method Based on Point Shift Amount Control and Its Evaluation", Lectures at the Autumn Conference of the Acoustical Society of Japan Vol. 1-4-14, October, 1986), etc.

Time-axis compression/expansion processing by a general cut-and-splice method is performed such that waveform segments of an original audio signal are cut out without considering correlation between the waveform segments and then the cut-out waveform segments are spliced together to thereby effect compression/expansion based on a specified compression/expansion rate. According to this method, discontinuities can occur in spliced portions of the cut-out waveform segments, and therefore cross-fading is carried out to smooth the spliced portions of the cut-out waveform segments. The time interval of the waveform cutout is set to such a time period that the human ears cannot sense an echo or doubling of sounds, e.g. approximately 60 msec. Particularly, according to the method disclosed in Japanese Laid-Open Patent Publication (Kokai) No. 10-282963, the cutout length or length of the cutout waveform segment is determined in synchronism with sound timing information. This method is distinguished from other conventional methods in that spliced portions appear at the same repetition period as that of the rhythm of the original waveform, so that tone changes at the spliced portions cannot be easily perceived.

On the other hand, the overlap-add method based on pointer shift amount control is performed such that two adjacent segments of the original audio signal most closely correlated in waveform and equal in length to each other are extracted, and the two signal segments are overlapped or added together. Then, the two original signal segments are replaced by a new signal segment obtained by the overlapping/addition, or the new signal segment is inserted between the two original signal segments, whereby the total time of the original audio signal is reduced or increased. This method enables smoother splicing of waveforms than the cut-and-splice method. Particularly, this method can achieve higher-quality time-axis compression/expansion of pitch-based sound source signals, such as voice signals and sound signals generated by monophonous musical instruments.

However, according to the conventional general cut-and-splice method, although it can provide a certain level of or higher sound quality irrespective of the kind of a signal to be processed, tone changes at the spliced portions of waveforms can be easily perceived depending on the cut-out positions which are determined independently of the waveforms, and particularly in a rhythm sound source, it is likely that very conspicuous sound quality degradation occurs, such as repeated generation of a tone and deviation in rhythm. Further, in a multitrack sound source having a plurality of tracks including a vocal track, a piano track, and a rhythm track, if the individual tracks are separately time-axis expanded or compressed, there can occur differences in tone generation timing between the tracks.

Further, according to the method disclosed in Japanese Laid-Open Publication (Kokai) No. 10-282963, which carries out the cut-and-splice processing in synchronism with the rhythm of the original waveform, two attacks can be included in one waveform segment obtained by cutting out a waveform for time-axis expansion, which results in repeated generation of a tone, i.e. a tone is generated twice. On the other hand, the overlap-add method based on pointer shift amount control is considered to be free from such repeated generation of a tone in principle, since the time-axis compression/expansion is carried out by checking the time correlation between adjacent waveform segments. However, this method does not ensure that the correlation in attack position can be maintained between before the time-axis compression or expansion and after the same, so that a deviation in rhythm is likely to occur.

SUMMARY OF THE INVENTION

It is an object of the present invention to provide a time-axis compression/expansion method and apparatus for multitrack signals, which is capable of performing time-axis compression/expansion on a multitrack signal in such an appropriate manner as to prevent a degradation in the sound quality of a sound generated through a multichannel reproduction or a sound generated through reproduction of a musical tone signal obtained by mix-down.

To attain the above object, according to a first aspect of the present invention, there is provided a time-axis compression/expansion method of time-axis compressing/expanding a multitrack sound source signal comprising a plurality of track sound source signals including a rhythm track sound source signal, comprising the steps of detecting positions of attacks of the rhythm track sound source signal of the plurality of track sound source signals, subjecting portions of the rhythm track sound source signal between the detected positions of attacks to a first time-axis compression/expansion process, and subjecting other track sound source signals of the plurality of track sound source signals than the rhythm track sound source signal to a second time-axis compression/expansion process, based on the detected positions of attacks.

Preferably, the first time-axis compression/expansion process is carried out on portions of the rhythm sound source signal other than the detected positions of attacks and portions proximate thereto, so as to smoothly join opposite ends of each of the portions of the rhythm sound source signal that are time-axis compressed/expanded to portions of the rhythm sound source signal that are not time-axis compressed/expanded, and the second time-axis compression/expansion process is carried out on the other track sound source signals such that joined portions of each of the other track sound source signals that are time-axis compressed/expanded synchronize with the detected positions of attacks.

In a preferred embodiment of the first aspect, the first time-axis compression/expansion process comprises determining a segment length of two adjacent waveforms of the rhythm track sound source signal between the detected positions of attacks, which show highest similarity to each other, superposing two adjacent waveforms having a basic period determined by the segment length upon each other, and replacing the two adjacent waveforms by the resulting superposed waveform or inserting the resulting superposed waveform between the two adjacent waveforms.

To attain the above object, according to a second aspect of the present invention, there is provided a time-axis compression/expansion apparatus for time-axis compressing/expanding a multitrack sound source signal comprising a plurality of track sound source signals including a rhythm track sound source signal, comprising an attack position detecting device that detects positions of attacks of the rhythm track sound source signal of the plurality of track sound source signals, a first time-axis compression/expansion processing device that subjects portions of the rhythm track sound source signal between the detected positions of attacks to a first time-axis compression/expansion process, and a second time-axis compression/expansion processing device that subjects other track sound source signals of the plurality of track sound source signals than the rhythm track sound source signal to a second time-axis compression/expansion process, based on the detected positions of attacks.

To attain the above object, according to a third aspect of the present invention, there is provided a time-axis compression/expansion method of time-axis compressing/expanding a multitrack sound source signal comprising a plurality of track sound source signals including a rhythm track sound source signal, comprising the steps of detecting positions of attacks of the rhythm track sound source signal of the plurality of track sound source signals, and time-axis compressing/expanding portions of the rhythm track sound source signal between the detected positions of attacks at a predetermined designated compression/expansion ratio without changing a pitch thereof.

Preferably, the time-axis compression/expansion process is carried out on portions of the rhythm sound source signal other than the detected positions of attacks and portions proximate thereto, so as to smoothly join opposite ends of each of the portions of the rhythm sound source signal that are time-axis compressed/expanded to portions of the rhythm sound source signal that are not time-axis compressed/expanded.

In a preferred embodiment of the third aspect, the time-axis compressing/expanding step comprises determining a segment length of two adjacent waveforms of the rhythm track sound source signal between the detected positions of attacks, which show highest similarity to each other, superposing two adjacent waveforms having, a basic period determined by the segment length upon each other, and replacing the two adjacent waveforms by the resulting superposed waveform or inserting the resulting superposed waveform between the two adjacent waveforms.

To attain the above object, according to a fourth aspect of the present invention, there is provided a storage medium storing a program which can be executed by a computer, for realizing a time-axis compression/expansion method of time-axis compressing/expanding a multitrack signal comprising a plurality of track sound source signals including a rhythm track sound source signal, the program comprising a module for detecting positions of attacks of the rhythm track sound source signal of the plurality of track sound source signals, a module for subjecting portions of the rhythm track sound source signal between the detected positions of attacks to a first time-axis compression/expansion process, and a module for subjecting other track sound source signals of the plurality of track sound source signals than the rhythm track sound source signal to a second time-axis compression/expansion process, based on the detected position of attacks.

To attain the above object, according to a fifth aspect of the present invention, there is provided a storage medium storing a program which can be executed by a computer, for realizing a time-axis compression/expansion method of time-axis compressing/expanding a multitrack signal comprising a plurality of track sound source signals including a rhythm track sound source signal, the program comprising a module for detecting positions of attacks of the rhythm track sound source signal of the plurality of track sound source signals, and a module for time-axis compressing/expanding portions of the rhythm track sound source signal between the detected positions of attacks without changing a pitch thereof and at a predetermined designated compression/expansion rate.

According to the present invention, attack positions of a rhythm track sound source signal of multitrack sound source signals are detected, and portions of the rhythm track sound source signal between the detected attack positions are subjected to time-axis compression or expansion. As a result, a change in the tone at a joint between waveforms joined together by a cross-fading process, for example, cannot be easily perceived by virtue of the auditory sense masking effect due to the signal characteristic that the signal power of attack positions of the rhythm track sound source signal is particularly large. Further, since the interval between the attack positions is also compressed or expanded at the compression or expansion rate, the relationship between the attack positions before the compression or expansion can be completely maintained even after the compression or expansion, thus providing a high-quality sound without any change in the tone being perceived, as is distinct from the conventional cut-and-spliced method. Moreover, since the other track sound source signals of the multitrack sound source signal than the rhythm track sound source are also subjected to time-axis compression/expansion based on the detected attack positions, a high-quality sound reproduction can be achieved without a change being perceived in the tone of a sound generated through a multichannel reproduction or a sound generated through reproduction of a musical tone signal obtained by mix-down, that is conventionally caused by the time-axis compression/expansion.

The above and other objects, features, and advantages of the invention will become apparent from the following detailed description taken in conjunction with the accompanying drawings.

DETAILED DESCRIPTION OF PREFERRED EMBODIMENTS

The present invention will now be described in detail with reference to drawings showing embodiments thereof.

Figure 1:
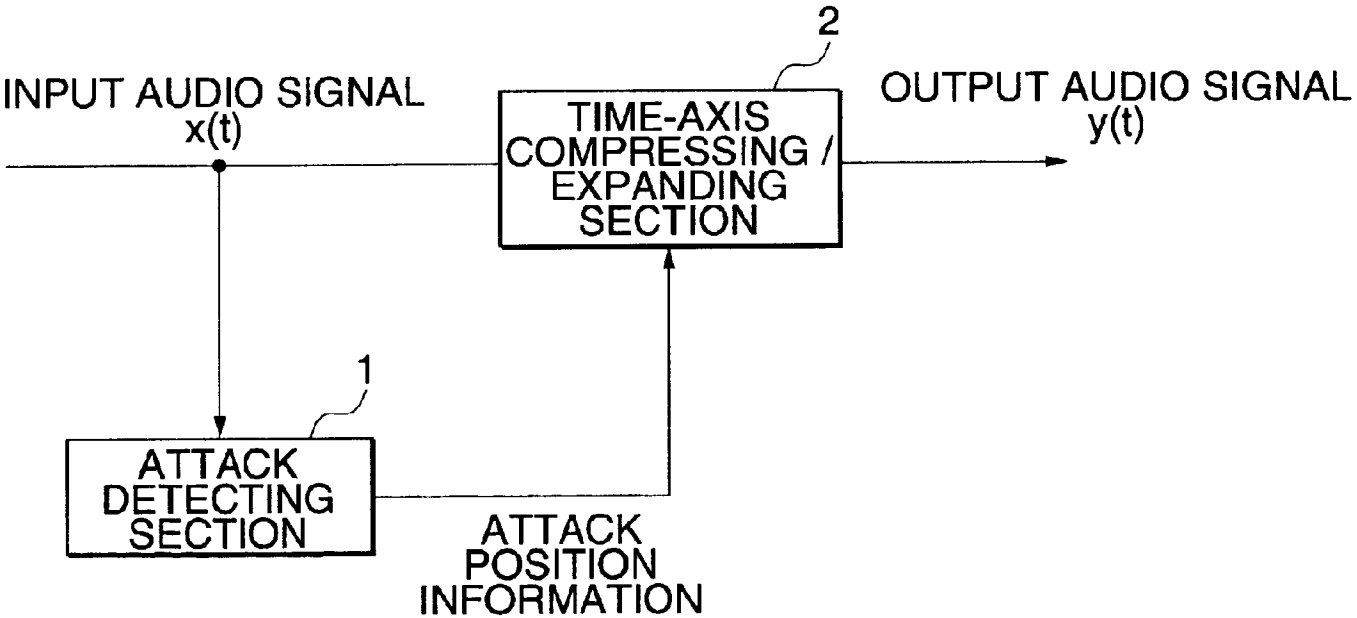
FIG. 1 is a block diagram showing the arrangement of a time-axis compression/expansion apparatus for performing time-axis compression/expansion on a multitrack sound source signal, according to a first embodiment of the present invention.

Referring first to FIG. 1, there is shown the arrangement of a time-axis compression/expansion apparatus for performing time-axis compression/expansion on a multitrack sound source signal, according to a first embodiment of the present invention.

A digital audio signal x(t) as a multitrack sound source signal to be time-axis compressed/expanded is input to an attack detecting section 1. The attack detecting section 1 detects an "attack" which is present in a rhythm track sound source signal of the multitrack sound source signal. More specifically, in view of the fact that an attack has a waveform level corresponding to a sharp rise or change in the power of the signal, the power of the signal per unit time is evaluated using a certain threshold value, and the obtained signal power is time-integrated, to thereby detect a sharp change point in the waveform from the time-integrated value. The two combined operations for detection of "attack" enables detecting almost all attacks in the rhythm track sound source signal, and results of the detection are delivered as attack position information to a time-axis compressing/expanding section 2.

On the other hand, the input audio signal x(t) is also supplied to the time-axis compressing/expanding section 2, which subjects a signal segment between adjacent attack positions of the rhythm track sound source signal as an input audio signal x(t) that have been detected by the attack detecting section 1, to time-axis compression/expansion processing. Similarly, the time-axis compressing/expanding section 2 also carries out time-axis compression/expansion processing on multitrack sound source signals for other tracks than the rhythm track, based on the detected attack positions. The compressing/expanding method employed by the time-axis compressing/expanding section 2 may include various methods such as the cut-and-splice method, the overlap-add method based on pointer shift amount control, and a method of repeating reverberation, dither, and looping. In the following, time-axis compression/expansion according to the cut-and-splice method will be mainly described.

Figure 2:
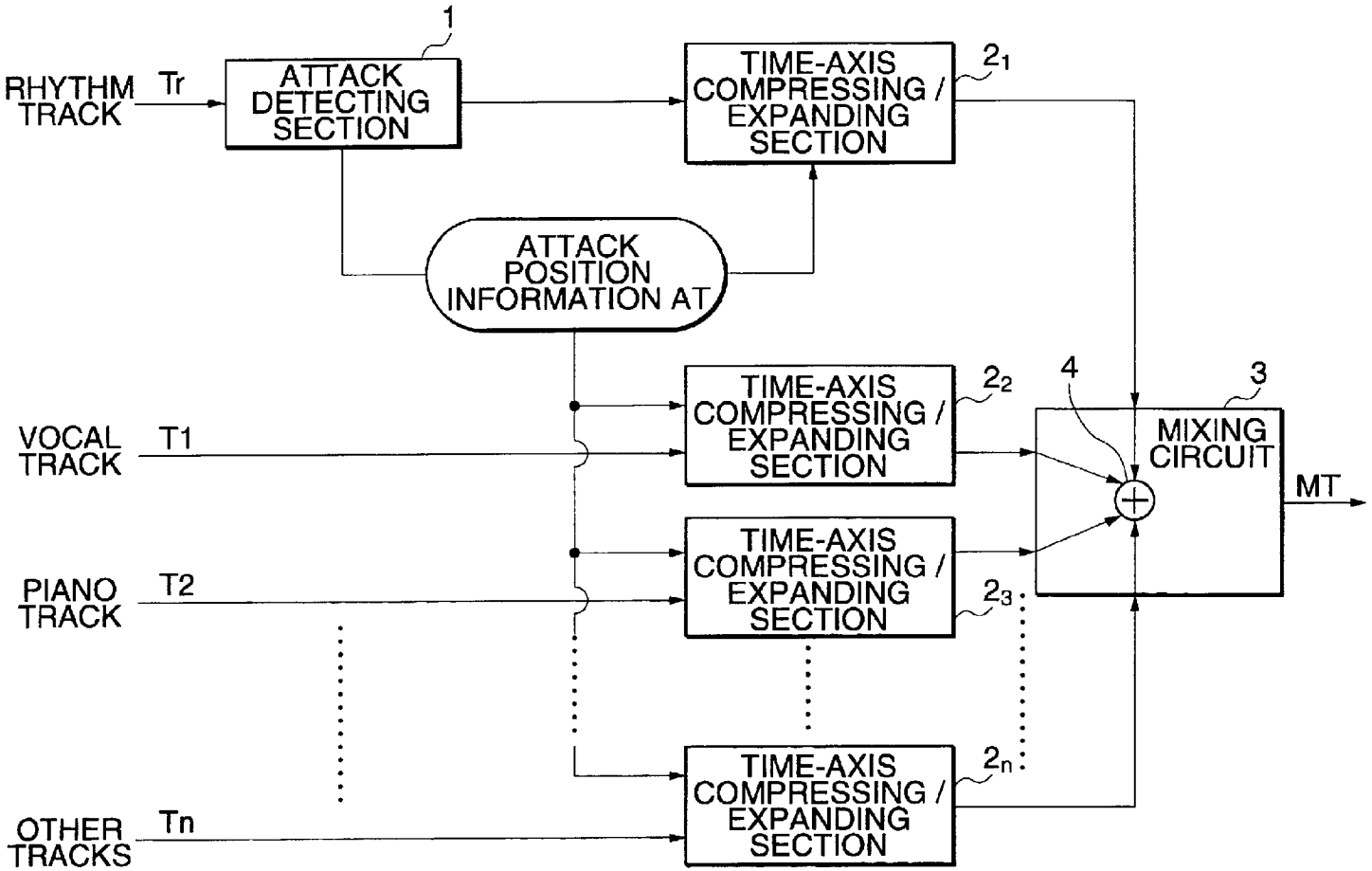
FIG. 2 is a block diagram showing the detailed arrangement of the time-axis compression/expansion apparatus of FIG. 1.

FIG. 2 shows details of the arrangement of the time-axis compression/expansion apparatus for multitrack sound source signals shown in FIG. 1.

Multitrack sound source signals that are input to the present apparatus include, for example, signals for a rhythm track Tr, a vocal track T1, a piano track T2, and other tracks Tn. The sound source signal for the rhythm track Tr is subjected to detection of attack positions by the attack detecting section 1. Attack position information AT obtained as a result of the detection is delivered to time-axis compressing/expanding sections $\mathbf{2}_1$, $\mathbf{2}_2$, $\mathbf{2}_3$, . . . $\mathbf{2}_n$ provided respectively for the tracks. The time-axis compressing/expanding sections $\mathbf{2}_1$, $\mathbf{2}_2$, $\mathbf{2}_3$, . . . , $\mathbf{2}_n$ each subject a signal segment between adjacent attack positions of the sound source signal for the corresponding track to time-axis compression/expansion processing. In this time-axis compression/expansion processing, by processing the cut-out waveforms such that the processed waveforms corresponding to opposite ends of each cut-out waveform are similar to the waveforms of the original signal or by subjecting the processed waveforms to cross-fading processing, the opposite ends of a signal segment obtained by the time-axis compression/expansion can be smoothly joined with signal segments not subjected to the time-axis compression/expansion processing with the joints being scarcely perceived. The sound source signals for the respective tracks thus time-axis compressed or expanded by the time-axis compressing/expanding sections $\mathbf{2}_1$, $\mathbf{2}_2$, $\mathbf{2}_3$, . . . , $\mathbf{2}_n$ are delivered to a mixing circuit 3. In the mixing circuit 3, the sound source signals for the respective tracks are added together or synthesized by an adder 4 in the mixing circuit 3, and the resulting mixed signal MT is outputted from the present time-axis compression/expansion apparatus.

Figure 3A:
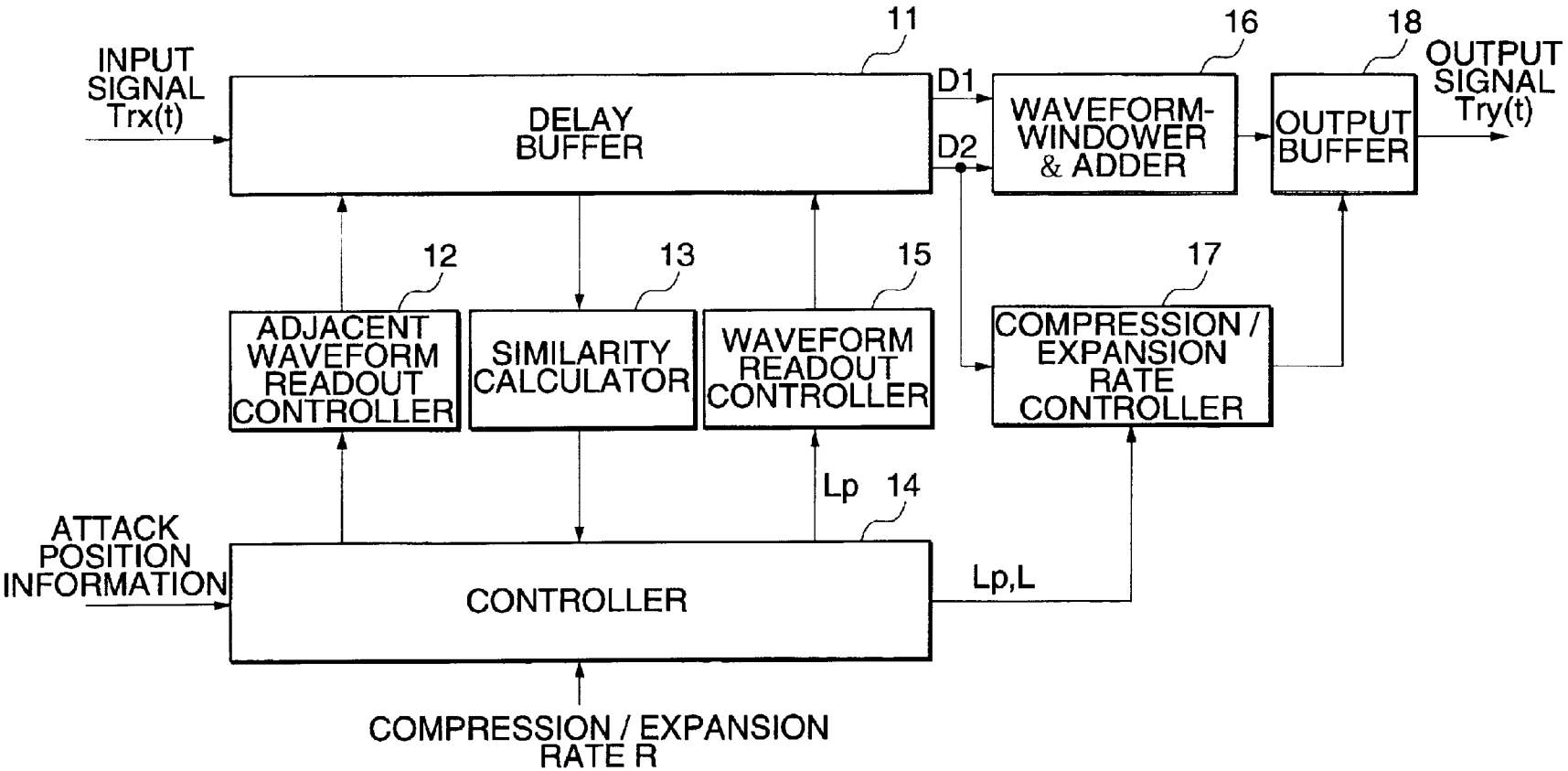
FIG. 3A is a block diagram showing the arrangement of a time-axis compressing and expanding section for a rhythm track, of the time-axis compression/expansion apparatus of FIG. 1.

FIG. 3A shows the basic construction of the time-axis compressing/expanding section 21 for the rhythm track sound source signal.

Among the multitrack sound source signals, the rhythm track sound source signal Trx(t) that is input is stored in a delay buffer 11. This delay buffer 11 is a ring buffer that stores an amount of data necessary for the time-axis expansion processing of waveforms, pitch extraction processing, and others, and the sound source signal stored in the delay buffer 11 is cut out into various segment lengths and the signal segments of various lengths are sequentially read out under the control of an adjacent waveform readout controller 12. A waveform similarity calculator 13 calculates similarity between data of adjacent waveforms, i.e. the waveforms of adjacent ones of the signal segments thus read out, under the control of the adjacent waveform readout controller 12. A controller 14 determines a segment length of adjacent waveforms which are most similar to each other, based on the calculated similarity, and delivers the determined segment length as a basic period (pitch) Lp to a waveform readout controller 15. The waveform readout controller 15 operates based on the attack position information AT delivered from the controller 14, to read out from the delay buffer 11 two pieces of data located apart from each other by an amount corresponding to the determined basic period Lp with respect to a signal segment lying between adjacent attacks. The two pieces of data D1, D2 read out from the delay buffer 11 are delivered to a compression/expansion processing control means which is comprised of a waveform-windower and adder 16, a compression/expansion rate controller 17, and an output buffer 18. The data D1, D2 delivered to the waveform-windower and adder 16 are multiplied by predetermined time window functions and are added together. One D1 of the data is also delivered to the compression/expansion rate controller 17, which extracts a waveform (original waveform) from the original audio data, based on information on an object length L for the compression/expansion processing given from the controller 14. The object length L for the compression/expansion processing is calculated from a predetermined compression/expansion rate R and the determined basic period Lp, by the controller 14. A waveform obtained through the addition by the waveform-windower and adder 16 and the original waveform extracted by the compression/expansion rate controller 17 are synthesized by the output buffer 18 into a time-axis compressed/expanded output rhythm track sound signal Try(t).

Figure 3B:
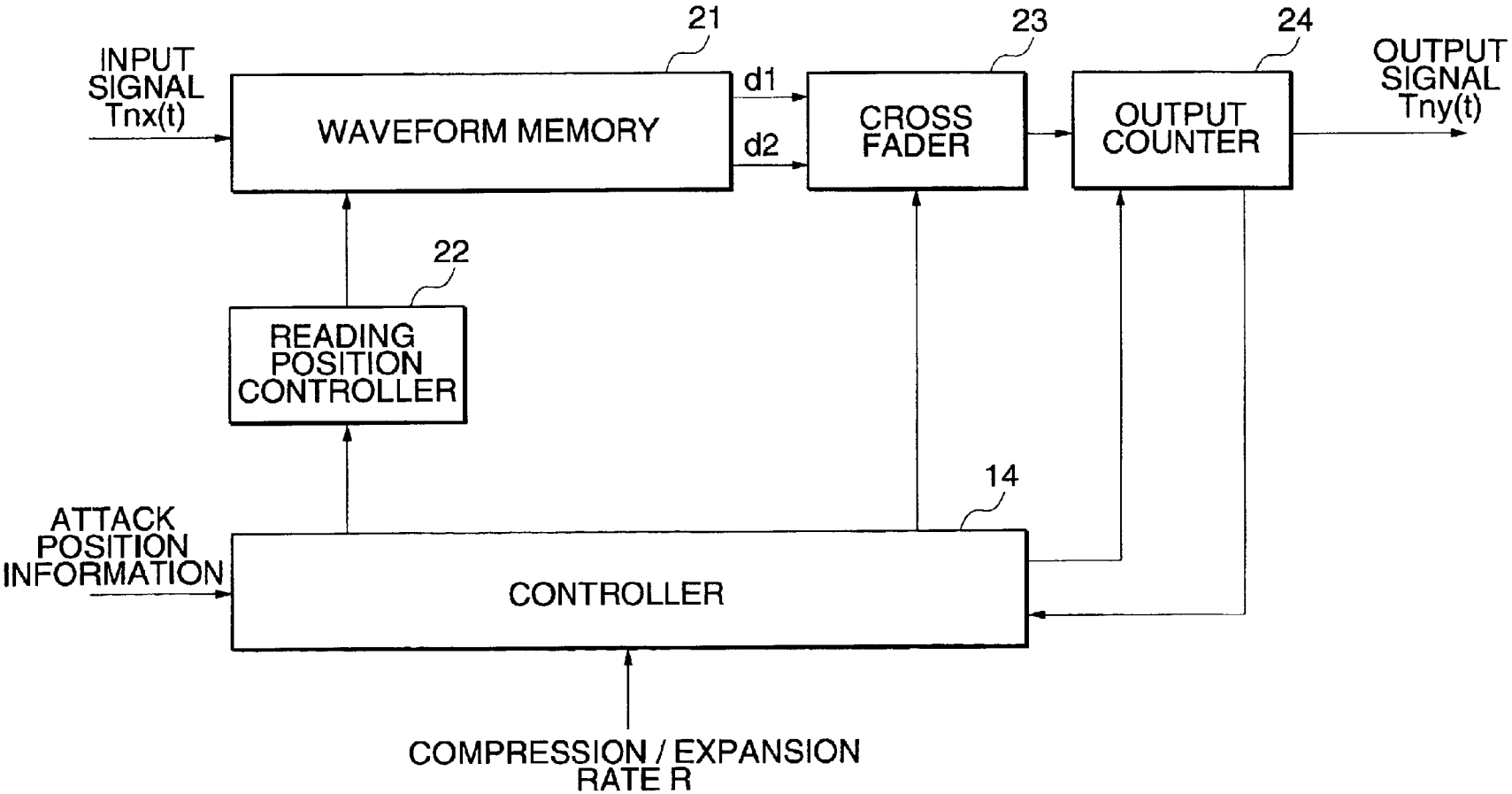
FIG. 3B is a block diagram showing the arrangement of a time-axis compressing/expanding section for a track other than the rhythm track, of the time-axis compression/expansion apparatus of FIG. 1.

FIG. 3B shows the basic construction of one of the time-axis compressing/expanding sections $\mathbf{2}_2$ to $\mathbf{2}_n$ for the track sound source signals other than the rhythm track sound source signal. The time-axis compressing/expanding sections $\mathbf{2}_2$ to $\mathbf{2}_n$ have the same basic construction.

A track sound source signal Tnx(t) to be time-axis compressed/expanded is sequentially stored in a waveform memory 21. The waveform memory 21 is a ring buffer that stores an amount of data necessary for time-axis expansion processing for waveforms, and others. The sound source signal stored in the waveform memory 21 is sequentially read out in a predetermined data length from various cut-out starting positions under the control of a reading position controller 22. The reading position controller 22 operates based on the compression/expansion rate R and the attack position information from the controller 14, to control reading positions of two pieces of data from the waveform memory 21. The two pieces of data d1, d2 read from the waveform memory 21 are delivered to a cross fader 23, where they are subjected to cross-fading processing based on the attack position information from the controller 14, i.e. in synchronism with the same. An output counter 24 counts the number of data of an output signal from the cross fader 23, and generates an output multitrack sound source signal Tny(t) resulting from the cross-fading processing. The controller 14 determines a cross-fading time period, based on the compression/expansion rate R designated through an external device, a length of data to be cut out, based on the attack position information, etc. Further, the controller 14 sets the thus determined cut-out data length to the output counter 24, and when the output counter 24 counts up the cut-out data length, the controller 14 controls the sections 22, 23 to execute the next cutting-out operation.

Next, the operation of the apparatus according to the present embodiment constructed as above will be described.

Figure 4:
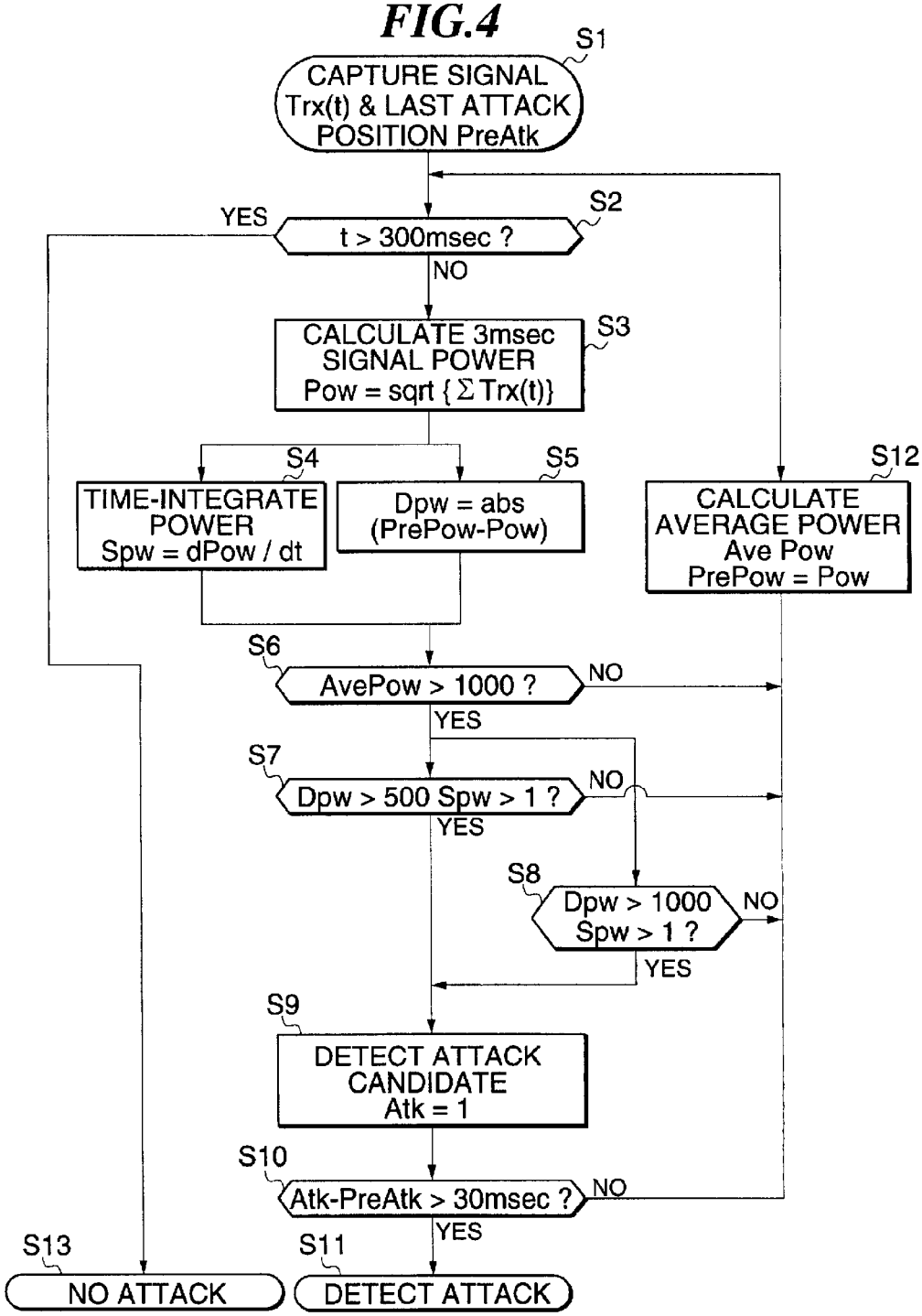
FIG. 4 is a flow chart showing a process carried out by an attack detecting section of the time-axis compression/expansion apparatus of FIG. 1.

FIG. 4 is a flow chart showing a procedure of the attack detecting process for the rhythm track sound source signal Trx(t) carried out by the attack detecting section 1.

Figure 6:
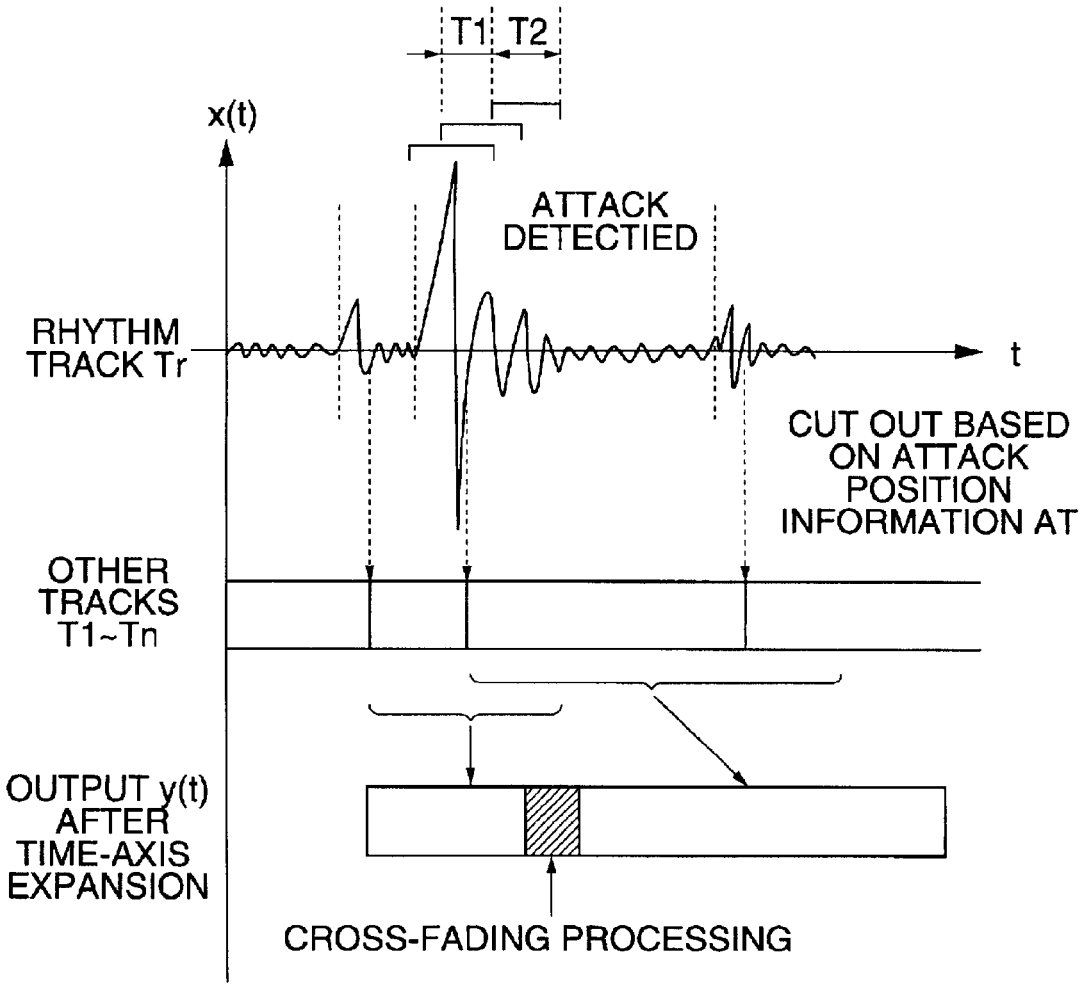
FIG. 6 is a timing chart showing a signal power calculation time period, an updating time period, and a signal obtained by time-axis expansion by a time-axis compressing/expanding section.

The position of an attack can be determined from the signal power Pow and its time-integrated value Spw. The calculation of the signal power Pow is carried out by sequentially updating a signal segment over a predetermined signal power calculation time period T1 using a predetermined signal power evaluation updating time period T2, as shown in FIG. 6. Here, it is assumed that T1=3 msec, and T2=1 msec.

First, at a step S1 in FIG. 4, the input signal Trx(t) and an attack position PreAtk immediately preceding on the time axis are captured. It is then determined at the next step S2 whether or not a time period t over which no attack has been present in the captured input signal Trx(t) exceeds a predetermined time period (e.g. 300 msec). If the answer is affirmative, the process proceeds to a step S3, wherein the signal segment of the captured input signal Trx(t) over the predetermined time period of 300 msec is time-axis compressed/expanded, whereas, if the answer is negative, the process proceeds to a step S3, wherein the signal power Pow is determined from the signal segment of the input signal Trx(t) over the time period of 3 msec using the following equation 1:

$$Pow=sqrt[\Sigma Trx(t)(1)] \tag{1}$$

Then, at a step S6, an average value of the determined signal power Pow is evaluated with reference to a threshold value set to 1000, for example. However, to discriminate a true attack from a change in the signal waveform which is a mere sharp rise but has a considerably long falling duration, an absolute difference value Dpw between the determined signal power Pow and a signal power PrePow obtained in the last frame is determined using the following equation (2):

$$Dpw=abs(PrePow-Pow) \tag{2}$$

Then, at steps S7 and S8, it is determined whether the determined absolute difference value Dpw exceeds a threshold value of 500 and a threshold value of 1000, respectively. That is, the threshold value should desirably be changed between a portion of the signal having a large average power AVePow and a portion of the signal having a small average power AVePow, because if an attack exists in a portion of the signal having a large average power AVePow, the difference value Dpw will be small, whereas, if an attack exists in a portion of the signal having a small average power AVePow, the difference value Dpw will be large due to a sharp rise of the attack. More specifically, the threshold value of the difference value based on the square root of the power, i.e. the amplitude scale of the original signal is set to 500, for example, for a portion of the signal having a large average power AVePow at the step S7, and to 1000, for example, for a portion of the signal having a small average power AvePow at the step S8. Also in the evaluation of the average power AvePow at the step S6, the threshold value is set to 1000 as in the step S8.

The time-integrated value Spw of the signal power Pow thus calculated is determined using the following equation (3):

$$Spw=dPow/dt \quad (3)$$

In calculating the time-integrated value Spw, to detect a position a little earlier than a true attack, it is desirable that signal power values in past three frames are averaged, and based on the resulting average value, the time-integrated value or gradient Spw of the signal power is calculated. The steps S7 and S8 also determine whether or not the calculated gradient Spw is larger than a predermined threshold value of 1.

Through the above described operations, an attack candidate Atk is detected at a step S9. Since the time intervals between most of actual attacks are more than 30 msec, at steps S10 and S11, it is determined whether or not at the time of detection of the present attack, more than 30 msec have elapsed after the last attack was detected, in order to detect an attack. If no attack is detected, the average power AvePow is calculated and the last power PrePow is updated at a step S12, followed by repeating the above described operations. If no attack has been detected after the lapse of 300 msec, the signal segment of the input signal Trx(t) is subjected to time-axis compression/expansion at the steps S2 and S13, as mentioned above.

Figure 5:
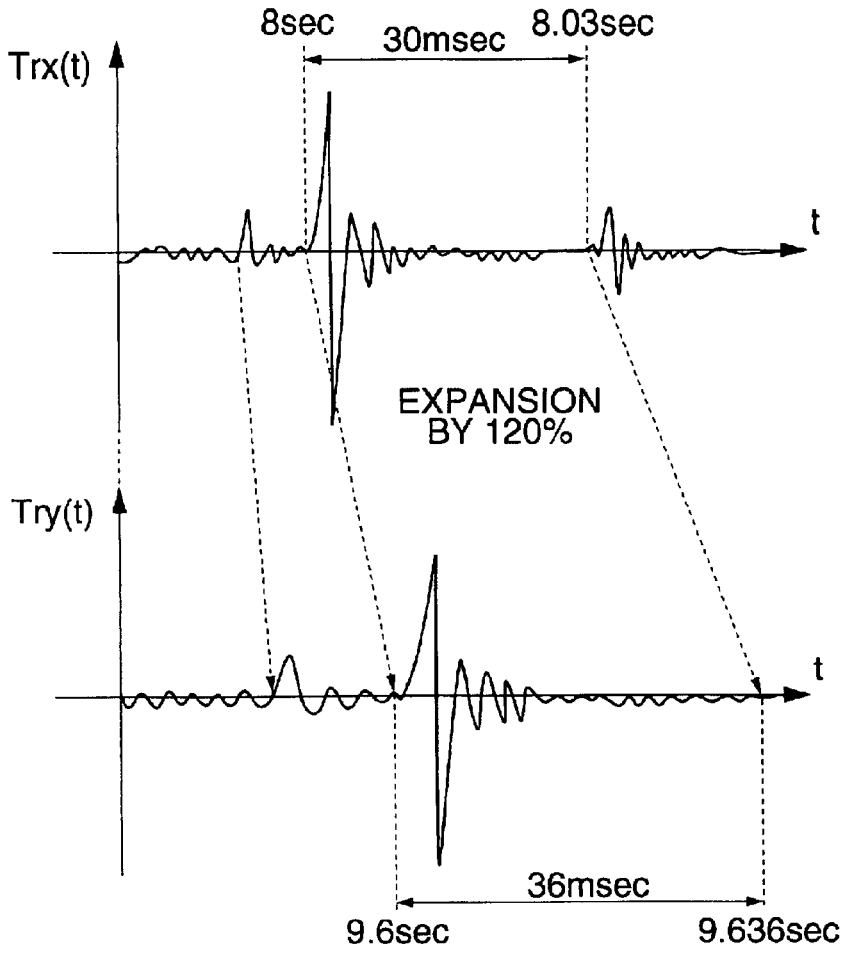
FIG. 5 is a timing chart showing waveforms of a signal before time-axis expansion and after the same obtained by the time-axis compression/expansion apparatus of FIG. 1.

For example, let it be assumed that as shown in FIG. 5, attacks of the input rhythm track sound source signal Trx(t) are detected at a time point 8 sec have elapsed and at a time point 8.03 sec have elapsed after the inputting of the signal Trx(t). If the expansion rate is 120% at this time, a signal segment over 30 msec between the two attacks is expanded to a length of 36 msec. If the position of a first attack of the output signal Try(t) after the time-axis expansion is a position determined by the previous time-axis expansion, e.g., 9.6 sec, the position of the next attack is 9.636 sec after 36 msec from the position of the first attack.

Based on attack positions thus determined from the rhythm track Tr, the time-axis compressing/expanding sections $\mathbf{2}_1$ to $\mathbf{2}_n$ carry out cutting-out of waveforms for the other tracks $T_1$ to $T_n$ according to the determined attack position information AT, and subject the cut-out waveforms according to the cut-and-splice method. In the example of FIG. 6, where the time-axis expansion is carried out, opposite ends of a time-axis expanded signal segment and non-time-axis expanded signal segments are smoothly joined together by the cross-fading processing.

FIG. 7A to 7F show a manner of the time-axis compression process for the rhythm track sound source signal, and FIGS. 8A to 8F show a manner of the time-axis expansion process for the rhythm track sound source signal.

Figures 7A, 7B, 7C, 7D, 7E, 7F:
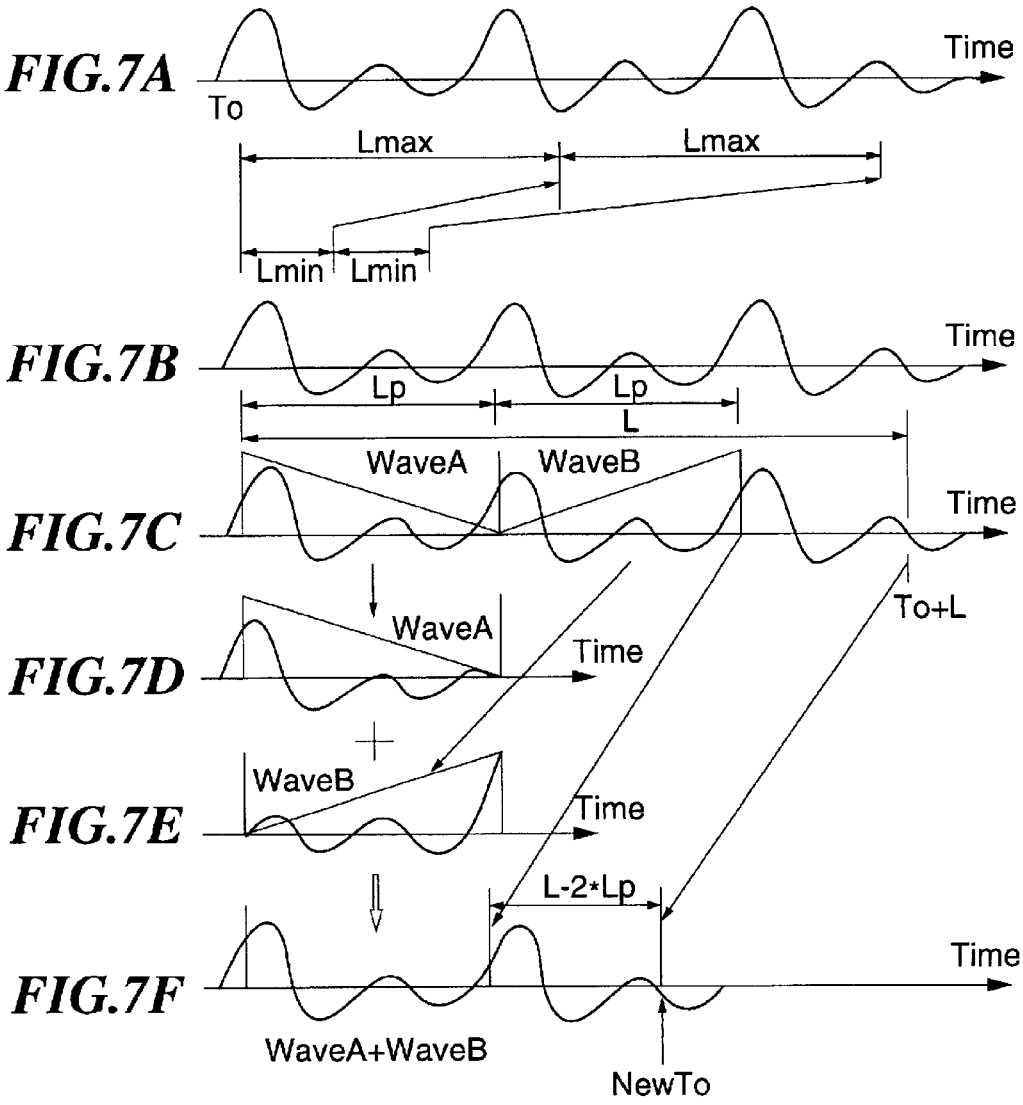
FIGS. 7A to 7F collectively form a timing chart useful in explaining a time-axis compression process for the rhythm track carried out by the apparatus of FIG. 1.
Figures 8A, 8B, 8C, 8D, 8E, 8F:
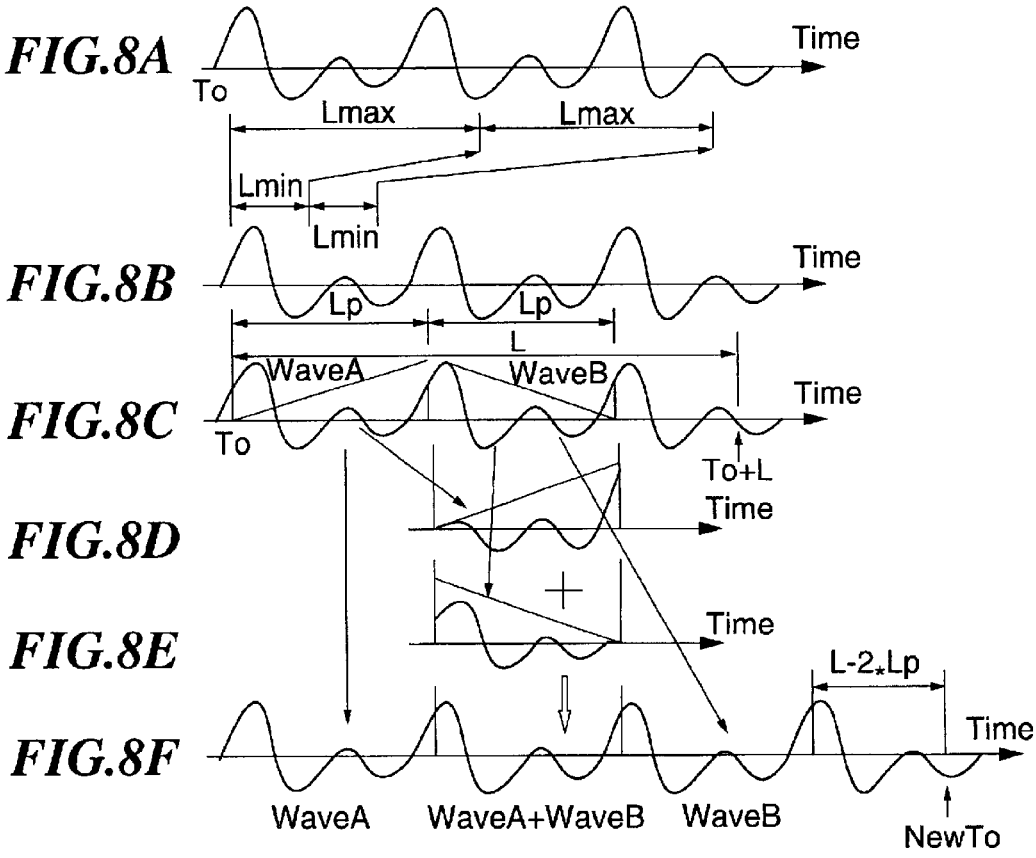
FIGS. 8A to 8F collectively form a timing chart useful in explaining a time-axis expansion process for the rhythm track carried out by the apparatus of FIG. 1.

First, as shown in FIGS. 7A and 8A, a determination of the similarity between adjacent waveform segments in the time axis direction of the original audio data is carried out to extract the basic period Lp. More specifically, an initial value of the segment length is set to a minimum value Lmin, and similarity between adjacent waveforms of the minimum segment length Lmin is determined. Then, a determination of similarity between adjacent waveforms is repeatedly carried out while progressively increasing the segment length until the segment length is increased to a maximum value Lmax. A segment length at which the waveform similarity is determined to be the highest is set as the basic period Lp, as shown in FIGS. 7B and 8B. Then, the adjacent waveforms A and B of the basic period Lp thus set are multiplied by window functions, as shown in FIGS. 7C and 8C, and the waveforms A, B thus multiplied by the window functions are superposed upon each other, as shown in FIGS. 7D and 7E and 8D and 8E. The time-axis compression is achieved by replacing the two waveforms of the basic period Lp by the resulting superposed waveform, as shown in FIG. 7F, while the time-axis expansion is achieved by inserting the superposed waveform between the two waveforms of the basic period Lp, as shown in FIG. 8F.

Figure 9:
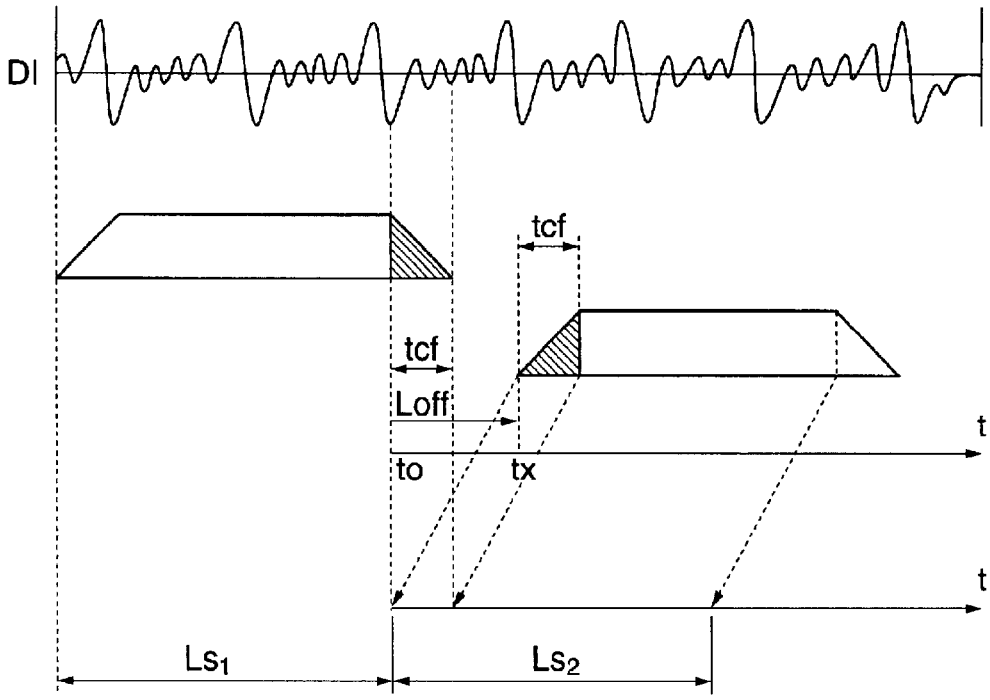
FIG. 9 is a timing chart useful in explaining a time-axis compression process for a track other than the rhythm track carried out by the apparatus of FIG. 1.

FIG. 9 shows a manner of the time-axis compression of the sound source signals for the other tracks than the rhythm track, and FIG. 8 shows a manner of the time-axis expansion of the sound source signals for the other tracks.

Figure 10:
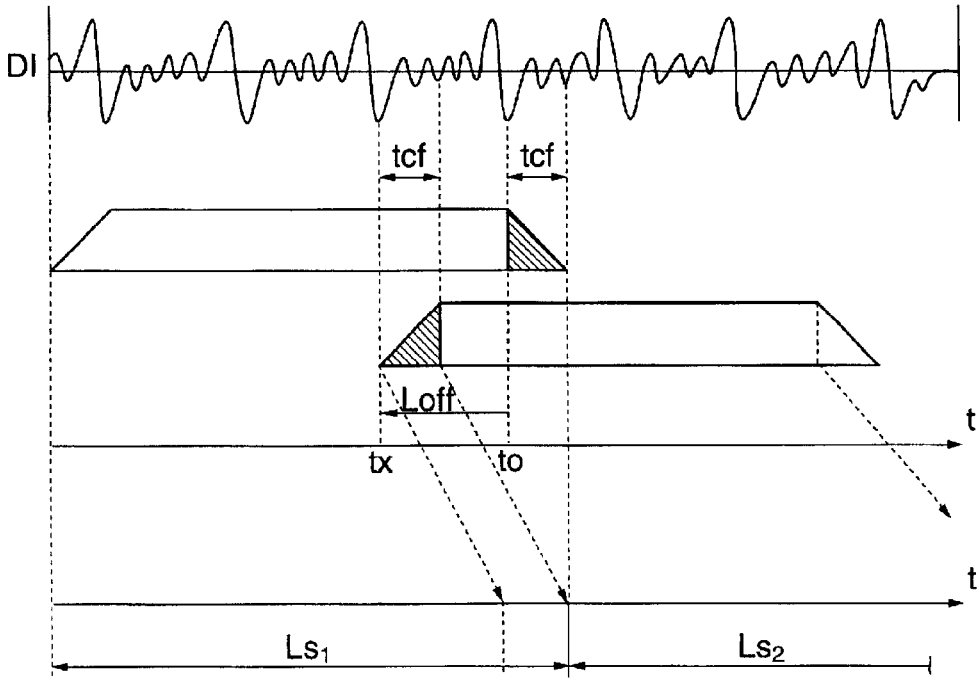
FIG. 10 is a timing chart useful in explaining a time-axis expansion process for a track other than the rhythm track carried out by the apparatus of FIG. 1.

The sound source signals for the other tracks than the rhythm track are subjected to cross-fading only at attack positions. This manner is desirable in view of an auditory sense masking effect for sounds at the attack positions. The cross-fading processing is carried out such that, assuming that waveforms are cut out in lengths $Ls_1$ and $LS_2$, a trailing end position of a first cut-out waveform is designated by to, and a leading end position of a second or following cut-out waveform is designated by tx, a trailing end portion of the first cut-out waveform and a leading end portion of the second cut-out waveform are subjected to cross-fading over a cross-fading time period tcf corresponding to each of the trailing end portion and the leading end portion within an offset time period Loff between the position to and the position tx. The time-axis compression is achieved by overlapping the cross-fading time period tcf with each of the waveform cut-out lengths $Ls_1$ and $LS_2$, as shown in FIG. 9, while the time-axis expansion is achieved by inserting the cross-fading time period tcf between the waveform cut-out lengths $Ls_1$ and $LS_2$, as shown in FIG. 10.

Figure 11:
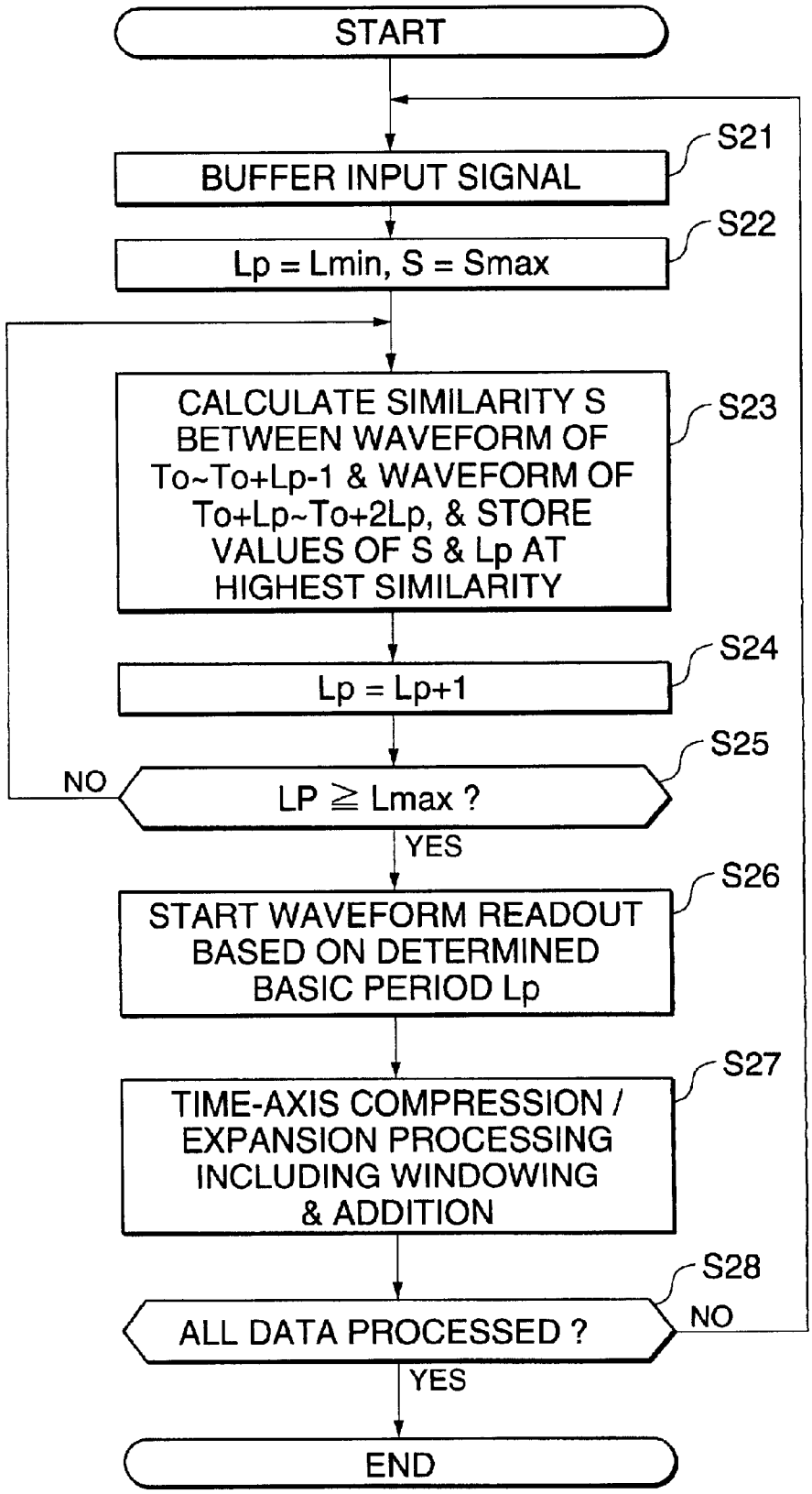
FIG. 11 is a flow chart showing a time-axis compression/expansion process for the rhythm track.

FIG. 11 is a flow chart showing a procedure of the time-axis compression/expansion process for the rhythm track sound source signal.

The input rhythm track sound source signal Trx(t) is stored in a required amount in the delay buffer 11 at a step S21. The capacity of the delay buffer 11 is required to be equal to a capacity for storing samples of waveforms of two times the maximum value Lmax of the segment length at the minimum. Then, at a step S22, the initial value of the basic period segment length Lp for the similarity determination is set to the minimum value Lmin, and similarity S is set to a maximum value Smax. Then, at a step S23, the similarity S is calculated, and at a step S24, the segment length Lp is increased by a value of 1. The calculation of the similarity S is continued until it is determined at a step S25 that the segment length Lp has reached the maximum value Lmax. Finally, a value of the segment length Lp at which the similarity S is determined to be the highest at the step S23 is determined.

As shown in FIGS. 7A to 7F and FIGS. 8A to 8F, the similarity determination is carried out by calculating similarity between the waveform A in a section from a present time point T0 to a time point T0+LP-1 and the waveform B in a section from a time point T0+Lp to a time point T0+2Lp. If positions in the time axis direction corresponding to these sections are designated by tx and tx+Lp, respectively, the similarity S can be determined from the square of the difference according to the following equation (4):

$$S = (1/Lp)\sum_{1=0}^{Lp-1}[D(tx) - D(tx + Lp)]2$$

The similarity S means that the smaller the value S, the higher the degree of similarity. Instead of using the square of the difference, the sum of absolute values of the difference or an autocorrelation function may be used.

At a step S26, by the waveform readout controller 15, based on the attack position information AT delivered to the controller 14, two pieces of data D1, D2 located apart from each other by an amount corresponding to the determined basic period Lp are read out from the delay buffer 11 with respect to a signal segment lying between adjacent attacks. Then, at a step S27, the two pieces of data D1, D2 read out from the delay buffer 11 are multiplied by the predetermined time window functions and are added together at the waveform-windower and adder 16. A waveform obtained through the addition by the waveform-windower and adder 16 and the original waveform extracted by the compression/expansion rate controller 17 are synthesized by the output buffer 18 into the time-axis compressed/expanded output rhythm track sound signal Try(t).

Figure 12:
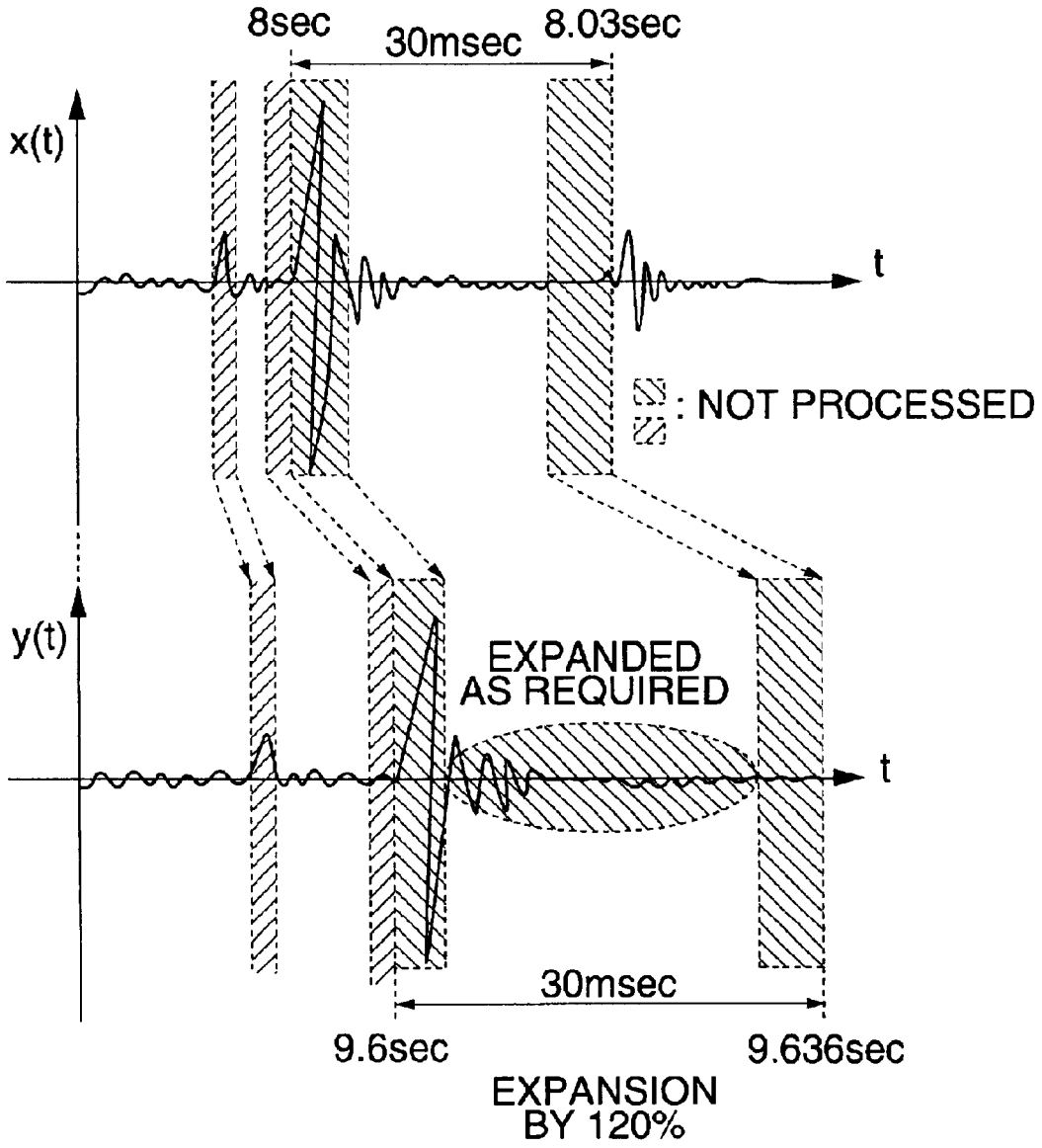
FIG. 12 is a timing chart showing waveforms of a signal before time-axis expansion and after the same obtained by a time-axis compression/expansion apparatus according to a second embodiment of the present invention.

The time-axis compressing/expanding section $\mathbf{2}_1$ carries out the time-axis compression or expansion as shown in FIG. 12, for example, such that of a signal segment of the rhythm track sound source signal Trx(t) between attacks a leading end portion (an attack position) and a trailing end portion (immediately before the next attack position) of the signal segment are left as they are, but an intermediate portion of the signal segment is time-axis compressed or expanded. Further, the time-axis compression/expansion processing is carried out so as to smoothly join the opposite ends of the signal portion subjected to the time-axis compression or expansion to signal portions not subjected to the time-axis compression or expansion. As a result of this manner of processing, waveforms of attacks which are most conspicuous in the rhythm track sound source signal are maintained as they are, and even if in the other track sound source signals, waveforms of attacks are subjected to time-axis compression or expansion to cause a change in the tone, such a change in the tone cannot be easily perceived by virtue of the auditory sense masking effect due to the signal characteristic that the signal power of the rhythm track sound source signal is larger than those of the other track sound source signals, thus providing a sound close to the genuine or natural sound.

In the time-axis compression/expansion processing based on the attack positions according to the present embodiment, what is important is that only the signal portion between attack positions should be processed to complete the time-axis compression/expansion processing, while the attack positions and signal portions immediately before or after each attack position should not be processed at all, and signal portions subjected to the time-axis compression or expansion and those not subjected to the same should be smoothly joined together. If the time-axis compression/expansion processing is carried out using the overlap-add method based on pointer shift amount control, there necessarily occur signal portions which fail to be time-axis compressed or expanded, and particularly, if the time-axis compression/expansion rate is nearly 100%, such signal portions not having been time-axis compressed or expanded become very long.

Figure 13:
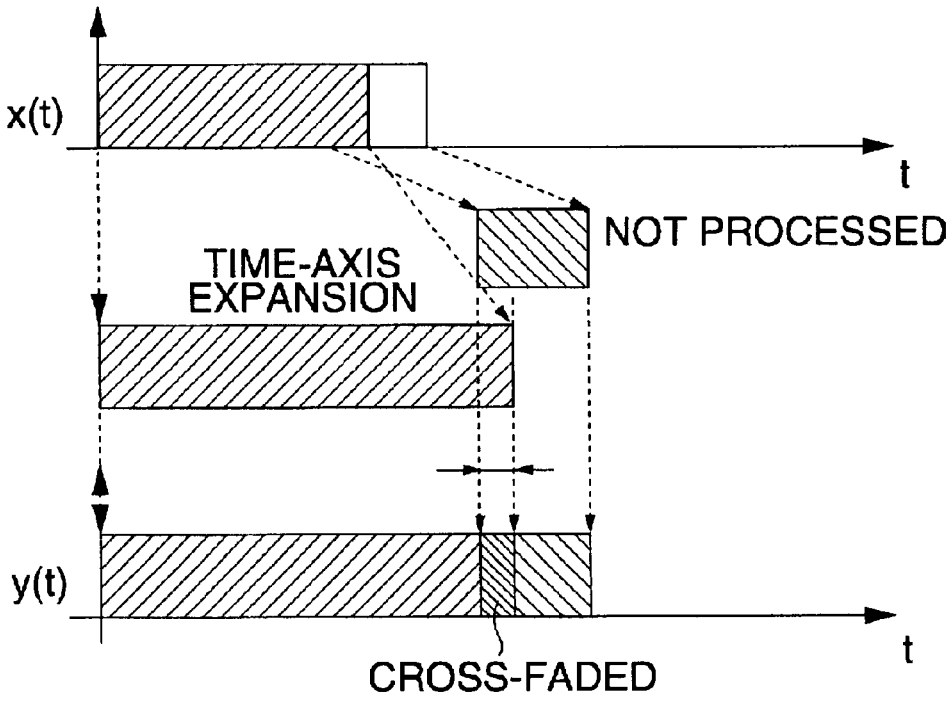
FIG. 13 is a diagram useful in explaining a cross-fading process carried out as a part of the time-axis expansion process by the time-axis compression/expansion apparatus according to the second embodiment.
Figure 14:
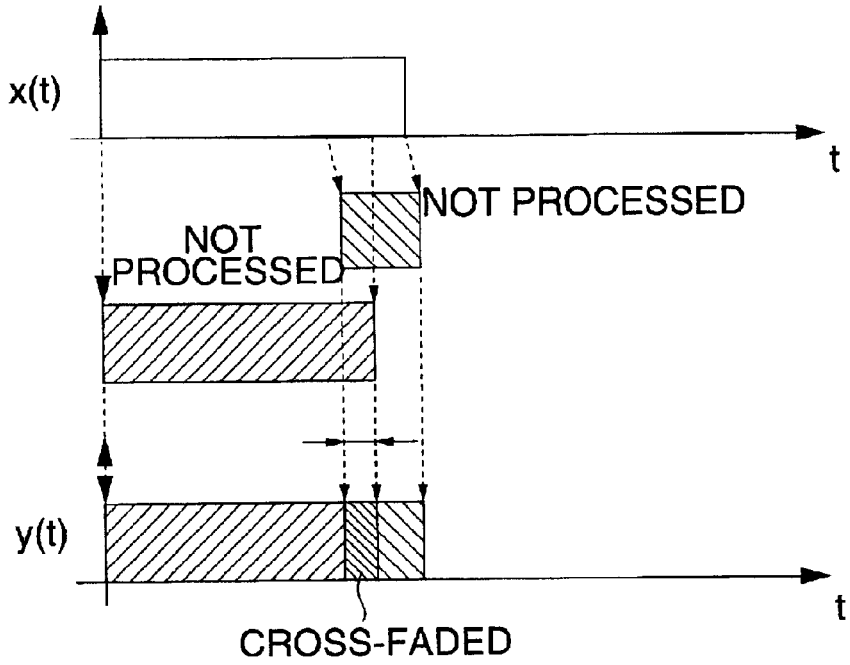
FIG. 14 is a diagram useful in explaining another cross-fading process carried out as a part of the time-axis expansion process by the time-axis compression/expansion apparatus according to the second embodiment.

FIG. 13 shows an example of countermeasure to cope with this problem, according to which a signal portion not having been time-axis expanded is processed by extracting data necessary for the cross-fading from a trailing end portion of the signal portion between attack positions and cross-fading part of the extracted data to thereby make the processing result temporally consistent. Further, to make up for a shortage of data necessary for cross-fading for time-axis expansion in FIG. 13, FIG. 14 shows a method of repeatedly cross-fading part of data of the trailing end portion between attack positions to thereby carry our time-axis expansion.

Figure 15:
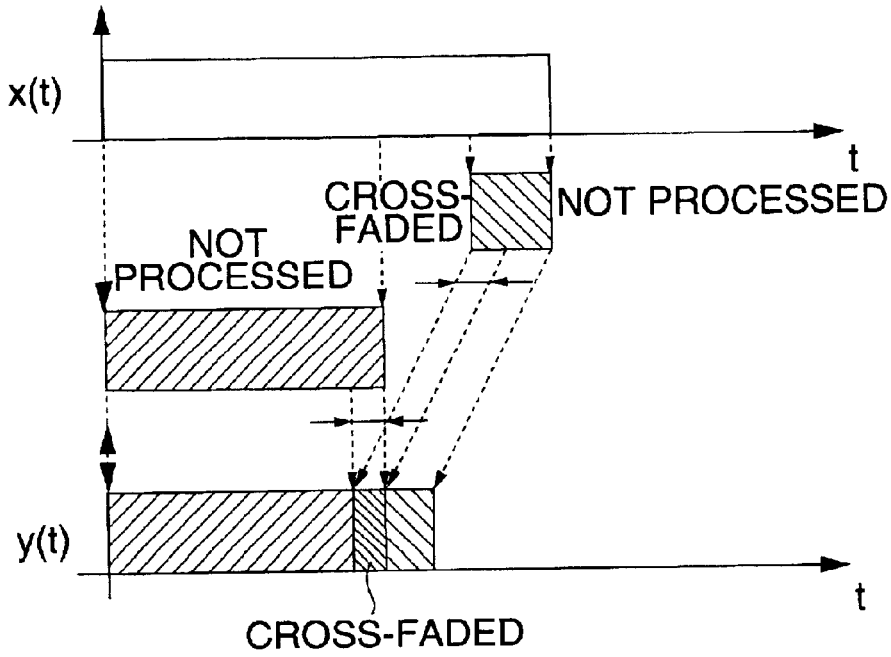
FIG. 15 is a diagram useful in explaining a cross-fading process carried out as a part of a time-axis compression process by a time-axis compression/expansion apparatus according to a third embodiment of the present invention.

Further, in the present embodiment, also signal portions not having been time-axis compressed are subjected to cross-fading to complete the time-axis compression, similarly to the time-axis expansion. An example of the method of this cross-fading is shown in FIG. 15. In compression of the signal, no shortage of data can occur, and therefore necessary data can be always extracted from a trailing end portion of the signal portion between attack positions to subject part of the extracted data to cross-fading in any case.

The present invention may be accomplished by supplying a program to the system or the apparatus. In this case, the effects of the present invention can be achieved by storing a program represented by a software for achieving the present invention in a storage medium and reading the program into the system or the apparatus.

The storage for storing the program maby be a floppy disk, a hard disk, an optical disk, a magneto-optical disk, a CD-ROM, a CD-R, a DVD, a magnetic tape, a non-volatile memory card, and others.

The functions of the above described embodiments may be realized by the following process. A program code read from the storage medium is written into a memory provided in a capability expansion board or a capability expansion unit connected to the computer, and a CPU or the like provided in the capability expansion board or the capability expansion unit executes a part or the whole of the actual operations according to instructions of the program code to realize the functions of the above described embodiments.

In this case, the program code itself read from the storage medium accomplishes the novel functions of the present invention, and thus the storage medium storing the program code constitutes the present invention.

The functions of the illustrated embodiments may be accomplished not only by executing the program code read by a computer, but also by causing an operating system (OS) on the computer, to perform a part or the whole of the actual operations according to instructions of the program code.

Further, the program for executing the time-axis compression/expansion method according to the present invention may be supplied from an external storage medium via a network such as electronic mail or personal computer communication.

What is claimed is:

1. A time-axis compression/expansion method of time-axis compressing/expanding a multitrack sound source signal comprising a plurality of track sound source signals including a rhythm track sound source signal, comprising the steps of:

detecting positions of attacks of said rhythm track sound source signal of said plurality of track sound source signals;

subjecting portions of said rhythm track sound source signal between the detected positions of attacks to a first time-axis compression/expansion process; and subjecting track sound source signals of said plurality of track sound source signals other than said rhythm track sound source signal to a second time-axis compression/ expansion process, based on the detected positions of attacks of said rhythm track sound source signal.

2. A time-axis compression/expansion method of time-axis compressing/expanding a multitrack sound source signal comprising a plurality of track sound source signals including a rhythm track sound source signal, comprising the steps of:

detecting positions of attacks of said rhythm track sound source signal of said plurality of track sound source signals:

subjecting portions of said rhythm track sound source signal between the detected positions of attacks to a first time-axis compression/expansion process; and subjecting track sound source signals of said plurality of track sound source signals other than said rhythm track sound source signal to a second time-axis compression/expansion process, based on the detected positions of attacks, wherein said first time-axis compression/expansion process is carried out on portions of said rhythm sound source signal other than the detected positions of attacks and portions proximate thereto, so as to smoothly join opposite ends of each of said portions of said rhythm sound source signal that are time-axis compressed/expanded to portions of said rhythm sound source signal that are not time-axis compressed/expanded, and said second time-axis compression/expansion process is carried out on said other track sound source signals such that joined portions of each of said other track sound source signals that are time-axis compressed/expanded synchronize with the detected positions of attacks.

3. A time-axis compressing/expanding method of time-axis compressing/expanding a multitrack sound source signal comprising a plurality of track sound source signals including a rhythm track sound source signal, comprising the steps of:

detecting positions of attacks of said rhythm track sound source signal of said plurality of track sound source signals;

subjecting portions of said rhythm track sound source signal between the detected positions of attacks to a first time-axis compression/expansion process; and subjecting track sound source signals of said plurality of track sound source signals other than said rhythm track sound source signal to a second time-axis compression/expansion process, based on the detected positions of attacks, wherein said first time-axis compression/expansion process includes determining a segment length of two adjacent waveforms of said rhythm track sound source signal between the detected positions of attacks, which have highest similarity to each other, superposing two adjacent waveforms having a basic period determined by said segment length upon each other, and replacing said two adjacent waveforms by the resulting superposed waveform or inserting the resulting superposed waveform between said two adjacent waveforms.

4. A time-axis compression/expansion apparatus for time-axis compressing/expanding a multitrack sound source signal comprising a plurality of track sound source signals including a rhythm track sound source signal, comprising:

an attack position detecting device that detects positions of attacks of said rhythm track sound source signal of said plurality of track sound source signals;

a first time-axis compression/expansion processing device that subjects portions of said rhythm track sound source signal between the detected positions of attacks to a first time-axis compression/expansion process; and a second time-axis compression/expansion processing device that subjects track sound source signals of said plurality of track sound source signals other than said rhythm track sound source signal to a second time-axis compression/expansion process, based on the detected positions of attacks of said rhythm track sound source signal.

5. A time-axis compression/expansion method of time-axis compressing/expanding a multitrack sound source signal comprising a plurality of track sound source signals including a rhythm track sound source signal, comprising the steps of:

detecting positions of attacks of said rhythm track sound source signal of said plurality of track sound source signals; and time-axis compressing/expanding portions of said rhythm track sound source signal between the detected positions of attacks at a predetermined designated compression/expansion ratio without changing a pitch thereof.

6. A time-axis compression/expansion method of time-axis compressing/expanding a multitrack sound source signal comprising a plurality of track sound source signals including a rhythm track sound source signal, comprising the steps of:

detecting positions of attacks of said rhythm track sound source signal of said plurality of track sound source signals; and time-axis compressing/expanding portions of said rhythm track sound source signal between the detected positions of attacks at a predetermined designated compression/expansion ratio without changing a pitch thereof;

wherein said time-axis compression/expansion process is carried out on portions of said rhythm sound source signal other than the detected positions of attacks and portions proximate thereto, so as to smoothly join opposite ends of each of said portions of said rhythm sound source signal that are time-axis compressed/expanded to portions of said rhythm sound source signal that are not time-axis compressed/expanded.

7. A time-axis compression/expansion method as claimed in claim 6, wherein said time-axis compressing/expanding step includes determining a segment length of two adjacent waveforms of said rhythm track sound source signal between the detected positions of attacks, which have highest similarity to each other, superposing two adjacent waveforms having a basic period determined by said segment length upon each other, and replacing said two adjacent waveforms by the resulting superposed waveform or inserting the resulting superposed waveform between said two adjacent waveforms.

8. A storage medium storing a program which can be executed by a computer, for realizing a time-axis compression/expansion method of time-axis compressing/expanding a multitrack signal comprising a plurality of track sound source signals including a rhythm track sound source signal, the program comprising:

a module for detecting positions of attacks of said rhythm track sound source signal of said plurality of track sound source signals;

a module for subjecting portions of said rhythm track sound source signal between the detected positions of attacks to a first time-axis compression/expansion process; and a module for subjecting track sound source signals of said plurality of track sound source signals other than said rhythm track sound source signal to a second time-axis compression/expansion process, based on the detected position of attacks.

9. A storage medium storing a program which can be executed by a computer, for realizing a time-axis compression/expansion method of time-axis compressing/expanding a multitrack signal comprising a plurality of track sound source signals including a rhythm track sound source signal, the program comprising:

a module for detecting positions of attacks of said rhythm track sound source signal of said plurality of track sound source signals; and a module for time-axis compressing/expanding portions of said rhythm track sound source signal between the detected positions of attacks without changing a pitch therefor and at a predetermined designated compression/expansion rate.

* * * * *